United States Patent [19]

Armond et al.

[11] Patent Number: 4,843,516

[45] Date of Patent: Jun. 27, 1989

[54] DEMAGNETIZING APPARATUS AND METHOD

[75] Inventors: Joseph A. Armond, River Grove; Jaunito Rodenas, Carol Stream, both of Ill.

[73] Assignee: Electro-Matic Products Co.

[21] Appl. No.: 100,997

[22] Filed: Sep. 21, 1987

[51] Int. Cl.[4] ..... B25B 11/00

[52] U.S. Cl. ..... 361/145; 361/147; 361/149

[58] Field of Search ..... 361/144, 145, 147, 148, 361/149

[56] References Cited

U.S. PATENT DOCUMENTS

| | | | |
|---|---|---|---|
| 3,401,313 | 9/1968 | Littwin | 361/145 |
| 3,428,867 | 2/1969 | Becker | 361/148 |
| 4,633,361 | 12/1986 | Ela et al. | 361/145 |

*Primary Examiner*—L. T. Hix
*Assistant Examiner*—David M. Gray
*Attorney, Agent, or Firm*—Paul H. Gallagher

[57] ABSTRACT

A chuck and a power transformer having a pair of secondaries for applying continuous unidirectional DC to the chuck. A pair of control transformers each having a pair of secondaries related to respective ones of the power secondaries, for producing opposite polarities on the chuck. A timer operable through a maximum time interval for controlling the control transformers and thereby producing DC on the chuck of a level according to that time interval, and settable to lesser time intervals for producing DC of correspondingly lesser levels. Means for producing DC in each of opposite polarities, and each throughout a corresponding time interval according to the setting of the timer. Oscillator means controlling the control transformers for thereby controlling the power transformer for producing DC of opposite polarities in a series of steps, and interposing resistances of successively greater values in the steps to reduce the charge on the chuck to zero at the last step. The oscillator has a predetermined, adjustable time interval of operation and operates independently of the timer.

9 Claims, 5 Drawing Sheets

DEMAGNETIZING APPARATUS AND METHOD

FIELD OF THE INVENTION

The invention resides in the field of demagnetizing pieces that have been magnetized, for future use thereof. The most common example of the use of such demagnetizing apparatus is in connection with a grinder. In a grinding operation, the piece referred to, known as a workpiece, is held on the chuck in the grinder, as the grinding operation is performed thereon. The workpiece is held down by a magnet, and to release the workpiece, the magnetic holding force is eliminated.

Referring generically to the demagnetizing field, the magnet may be, in one case, an electromagnet, and in another case, an electric permanent magnet. In the case of an electromagnet, to release the workpiece, the electromagnet is turned off, but there is considerable residual magnetism in the chuck and in the workpiece. In the steps of utilizing an electric permanent magnet, the permanent magnet is energized, or brought up to full magnetism, and the electrical circuit is then shut off. The permanent magnet thereon continues to hold the workpiece, by means of its magnetism which is the same as its natural magnetism.

In either case, that is, the electromagnet or the electric permanent magnet, the magnet is magnetized and demagnetized by an electrical circuit, but the present invention is directed to that portion of the field involving the electric permanent magnet.

While the ultimate objective is demagnetizing, in the broad performance of that function the step of magnetizing is also performed in virtually every instance of use of the chuck, and accordingly the demagnetizing apparatus is also referred to as a chuck control.

Although the apparatus has particular adaptability to grinding, it may also be applicable to other applications involving demagnetizing.

Cross References Presently Pending Applications for Patent

A. Ser. No. 571,387, filed Jan. 17, 1984, by the present inventor, Joseph A. Armond, Case 56.

B. Ser. No. 011,290, filed Feb. 5, 1987, by the present inventors, Case 60, now abandoned.

DESCRIPTION OF A PREFERRED EMBODIMENT

The apparatus of the present invention involves certain components that are also incorporated in the apparatuses disclosed in the above applications cited as cross references, and therefore in the present case, certain of the features thereof may be referred to generally, and reference may be made to those applications for details thereof.

As set out somewhat in detail in the above applications, demagnetizing has been developed to such a degree that magnetizing itself is necessarily incorporated in the overall apparatus and method of demagnetizing. Consequently, the apparatuses referred to, including that of the present instance, are used in the specific step of magnetizing also. In the industry, the terms MAG and MAGGING are understood to mean magnetize and magnetizing respectively, and similarly, the terms DEMAG and DEMAGGING mean demagnetize and demagnetizing respectively.

In the overall operations of magging and demagging, there are four recognized phases or levels of holding force of the magnet, namely, FULL, VARIABLE, RESIDUAL, and RELEASE, referred to also as modes. While in RELEASE, the holding force is theoretically depleted, it is referred to in the trade as a phase or level, and is so recognized herein for convenience.

In the FULL condition, the maximum holding force of which the apparatus is capable of producing, is established.

The VARIABLE mode is provided for establishing a holding force less than the maximum mentioned, but the greatest force in a given grinding operation, and is selected according to the nature of the respective grinding operation. Various workpieces are of different characteristics, according to mass, hardness, etc., and workpieces of different characteristics are to be held in place on the chuck by different holding forces, i.e. greater or lesser forces, and the VARIABLE mode is utilized for selectively predetermining greater or lesser forces that are maximum for the individual operations.

The RESIDUAL mode provides for a lesser holding force, to enable removal of a piece from the chuck for testing purposes. In a grinding operation, it is often desired to remove an individual piece from the chuck to check the grinding operation. To do this, a reduced holding force is established, above zero, that enables a workpiece to be removed, for the purpose mentioned, but it is strong enough to hold the remaining workpieces in place on the chuck, in the absence of extraneous forces tending to dislodge them. After the piece is tested, it is replaced on the chuck in its original position, and held in that position, and thereafter a greater holding force, such as FULL, is re-established and all of the workpieces are held in place as they were formerly, and the grinding operation is continued.

In the RELEASE mode, the DEMAGGING step is put into operation and all of the holding force is removed, or nearly so, and all of the workpieces are readily removable from the chuck.

Figure 1:
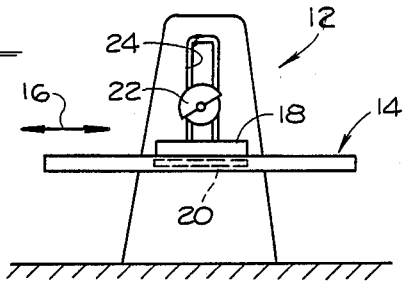
FIG. 1 is a simplified view of a grinder in which the demagnetizer of the present invention is utilized.

Referring in detail to the drawings, FIG. 1 shows a grinder 12 of known kind, having a table 14 that reciprocates longitudinally in horizontal direction as indicated by the double headed arrow 16, and the workpiece to be treated, indicated at 18, is placed on the table and held thereon by a magnetic chuck 20 embedded in the table. A grinding wheel 22 works in a vertical slot 24 and is brought down into working engagement with the workpiece, performing the grinding operation as the wrokpiece is reciprocted under it, by the table. The chuck, as will be referred to again, includes an electric permanent magnet for holding the workpieces, and is electrically demagnetized and magnetized. The magnet includes hard steel and a coil, and it retains its magnetism until demagnetized.

Figure 2:
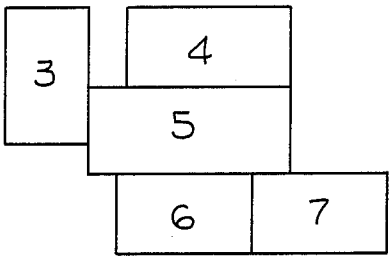
FIG. 2 is a diagram showing the arrangement of FIGS. 3–7 fitted together to form a complete circuit diagram.
Figure 3:
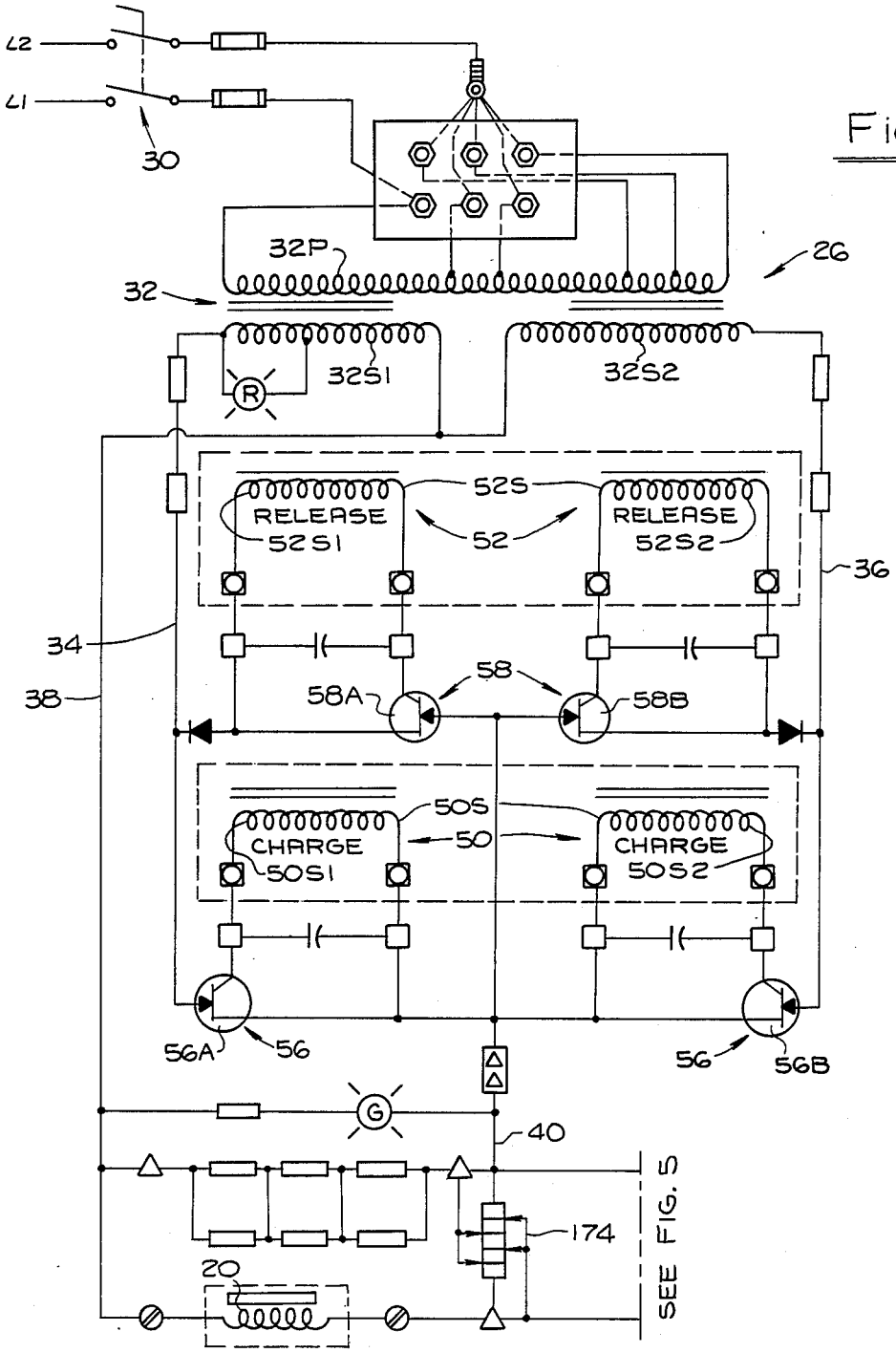
FIG. 3 is a diagram of a portion of the electrical circuit.

Referring to the electrical circuit, FIG. 2 shows the proximate positioning of FIGS. 3–7, and it will be noted that the chuck 20 is found in FIG. 3 at the bottom.

Figure 4:
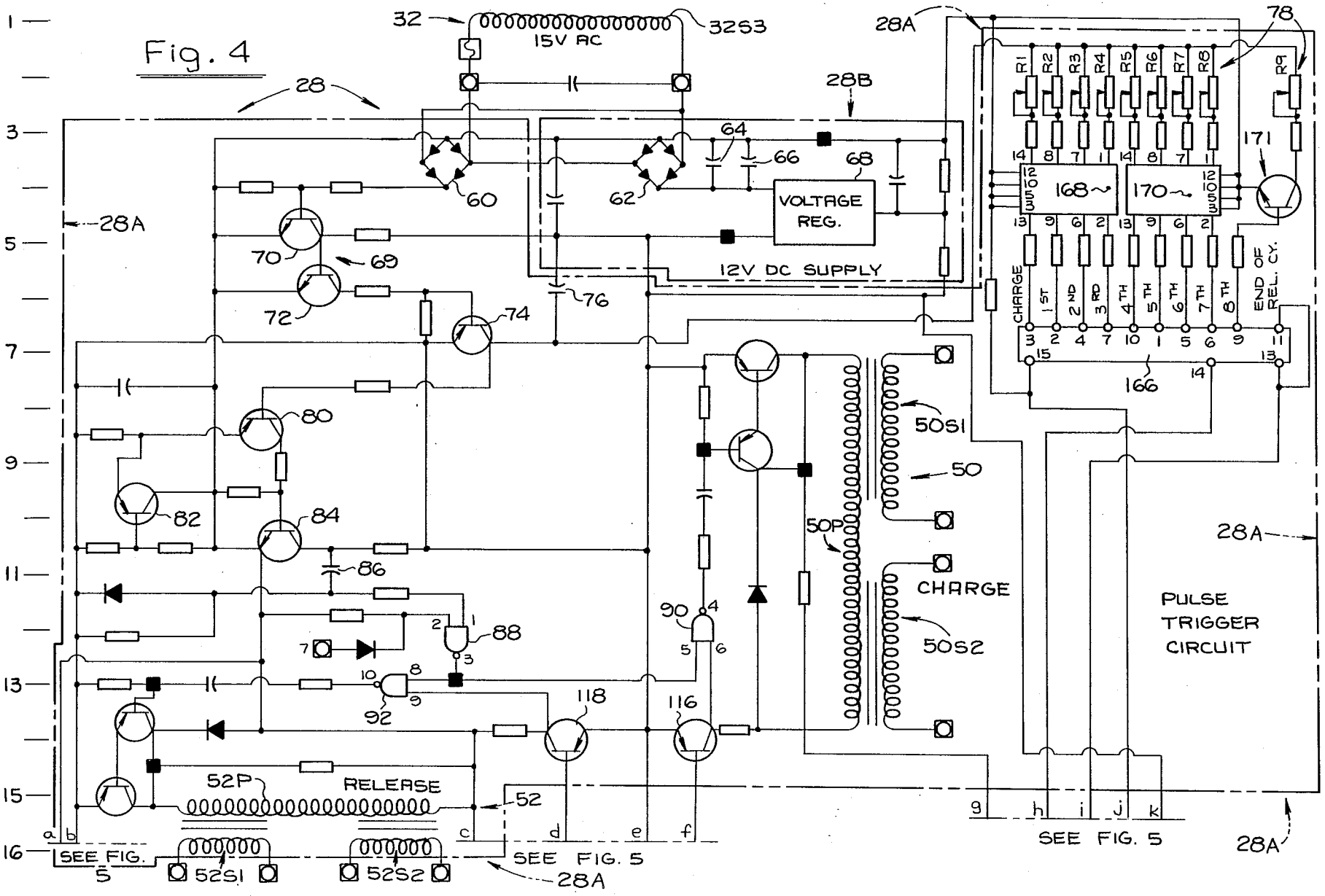
FIG. 4 is a diagram of another portion of the electrical circuit.
Figure 5:
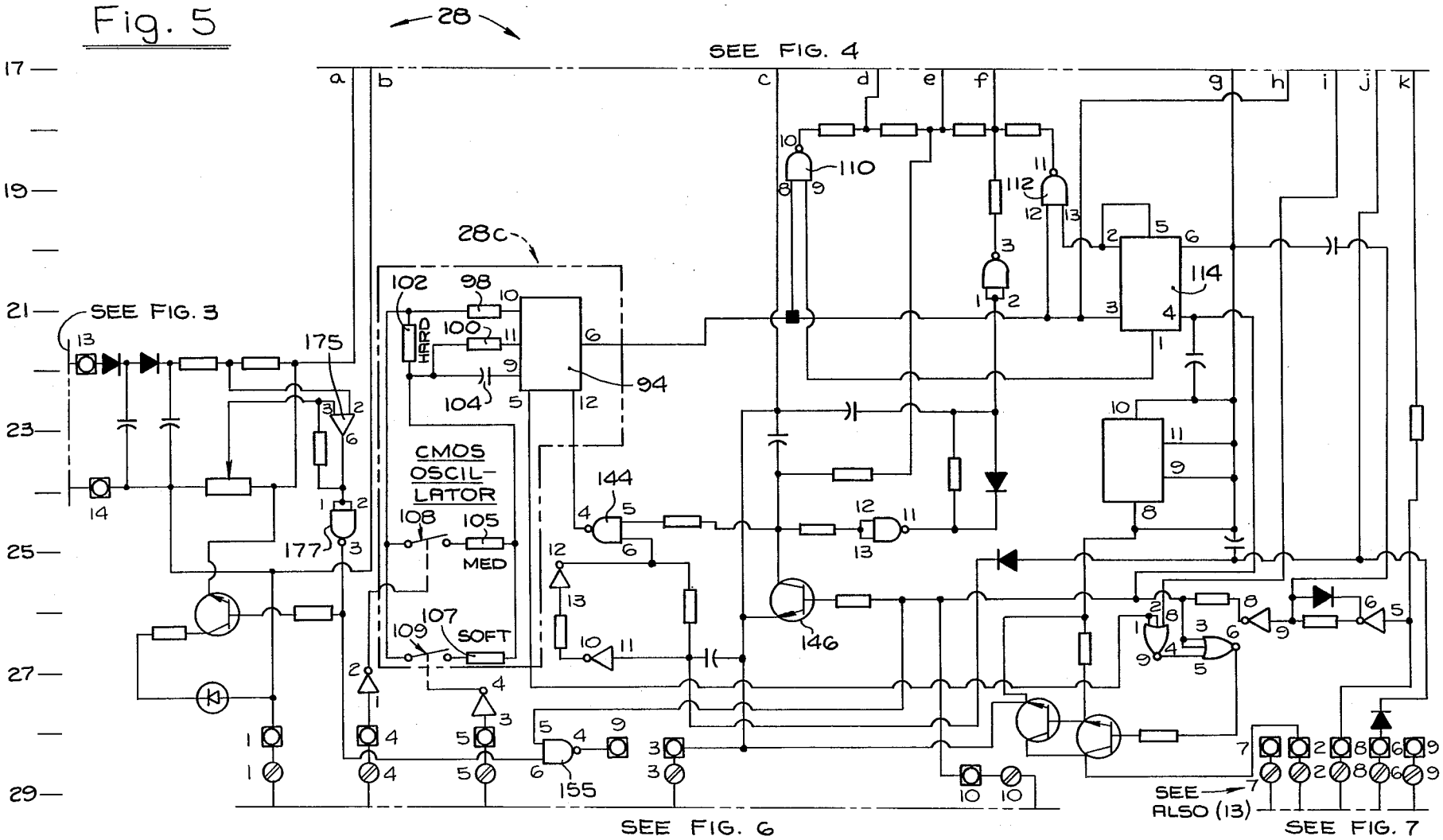
FIG. 5 is a diagram of still another portion of the circuit.
Figure 6:
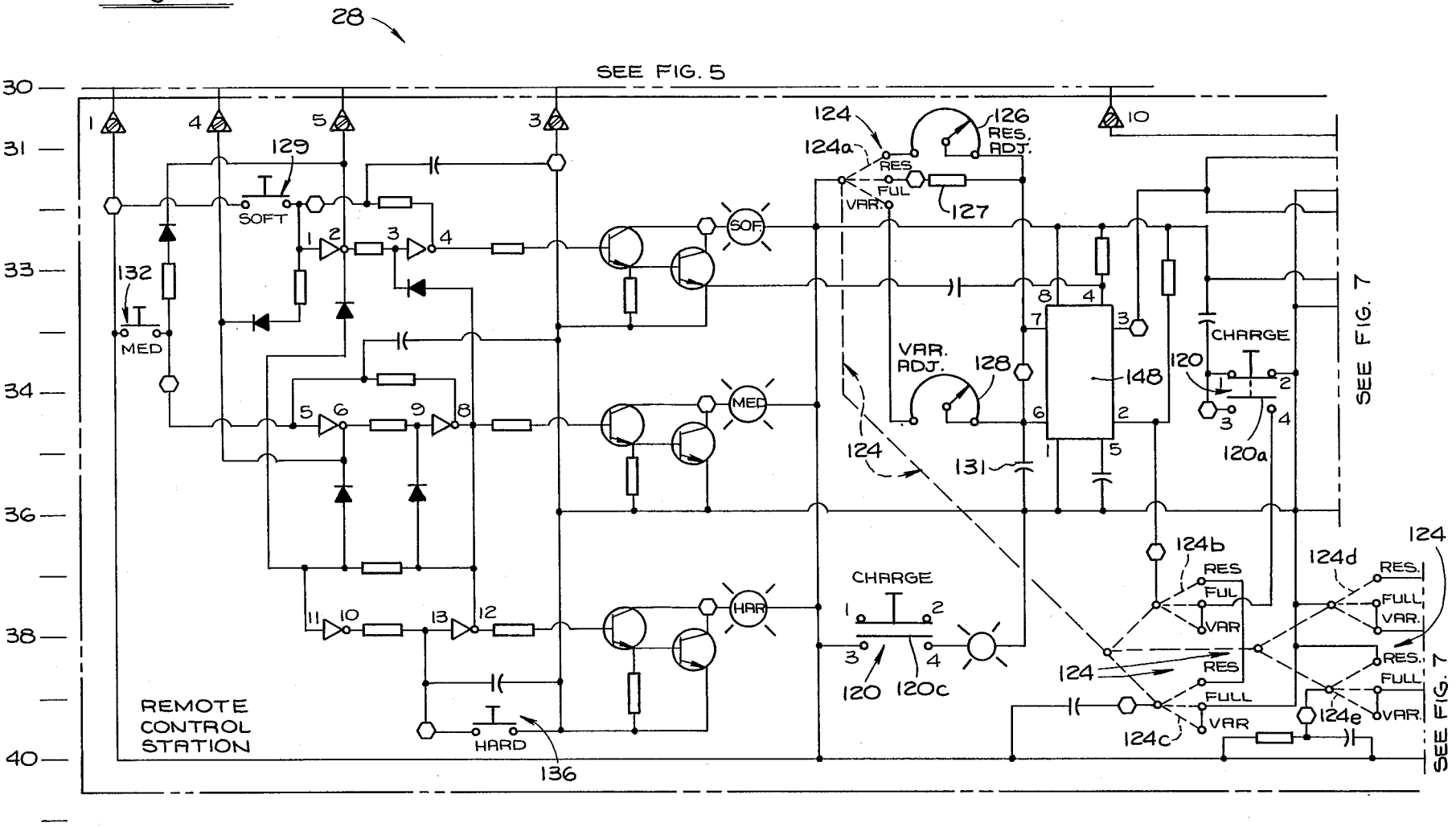
FIG. 6 is a diagram of an additional portion of the circuit.
Figure 7:
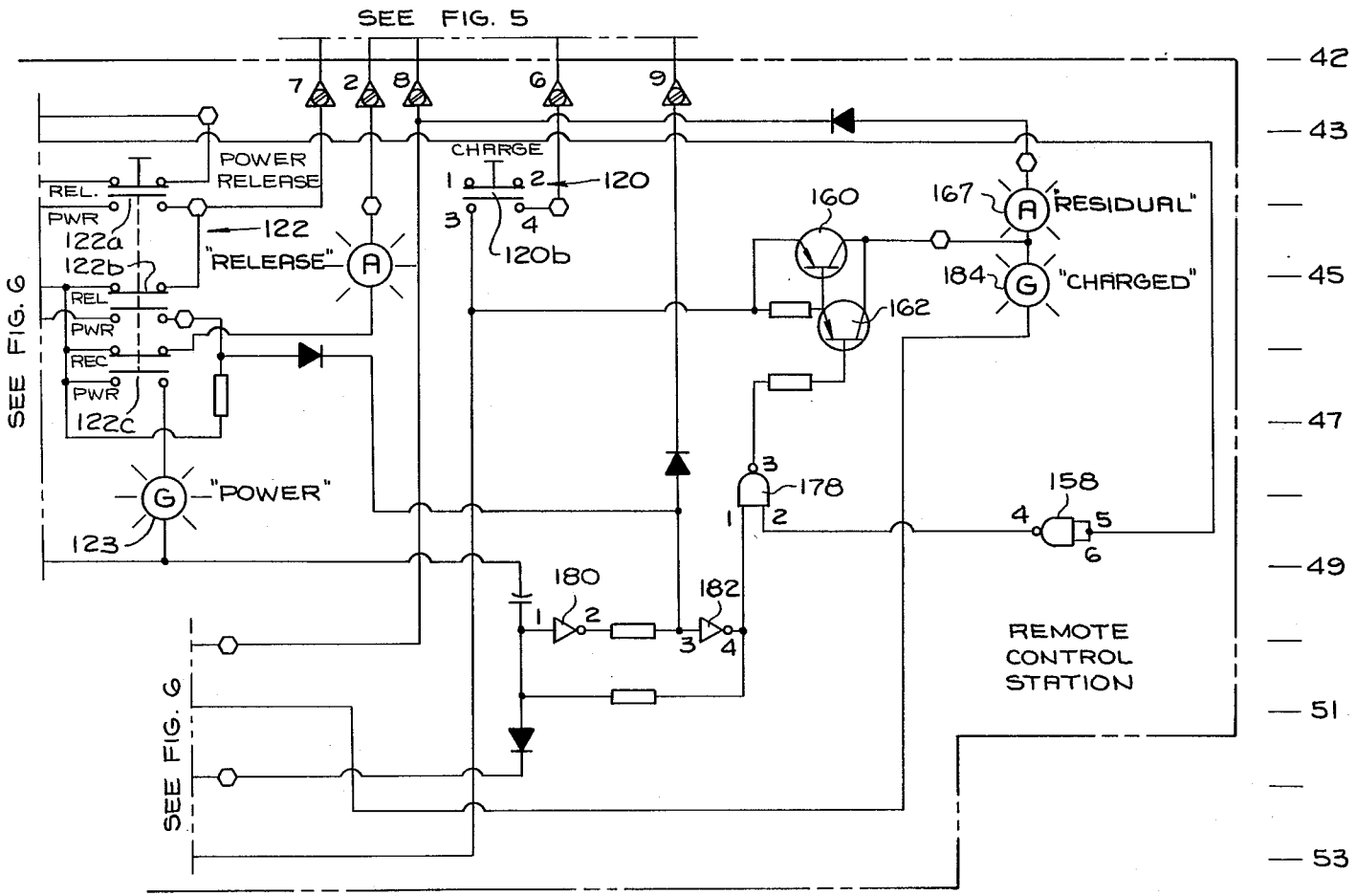
FIG. 7 is a diagram of the final portion of the circuit.

The overall circuitry includes a power circuit 26 in FIG. 3, and a control circuit 28 made up of the circuit portions of FIGS. 4–7 together, the latter including a pulse trigger circuit 28A(1, 4, 10, 16), a 12 VDC supply 28B(3), a CMOS oscillator 28C(20), and a remote control station 28D made up of the circuit portions of FIGS. 6 and 7 together.

The Power Circuit - FIG. 3

The power circuit 26 includes an AC source 30 leading to a power transformer 32, and conductors 34, 36, 38, 40, leading from the power transformer to the chuck 20.

The SCRs, transistors, rectifiers, triacs, and gates, may be referred to generally as valves.

In the identification of transformers herein, the primaries are identified with the same main reference numeral with the postscript P, and the secondaries also with the same main reference numeral but with the postscript S and additional postscript numerals 1, 2, etc.

In the electrical circuitry of FIGS. 4–7, the diagrams are provided with line numbers at the margins thereof to facilitate designating locations of the various elements referred to, these line numbers being given in parenthesis following the references to the corresponding elements in the description thereof.

The power transformer 32 includes what may be referred to for convenience as power secondaries 32S1 and 32S2 (FIG. 3) and a control secondary 32S3 (1).

The power circuit 26 (FIG. 3) includes the secondaries of certain magnetizing control transformers, which may also be referred to as control transformers, the complete transformers being incorporated in the circuit of FIG. 4. Each transformer includes a primary and two secondaries, each being referred to as a set, and are referred to as a CHARGE set or ON set 50 and a RELEASE set or DEMAG set 52. These transformers function to control the current passing from the power transformer 32 to the chuck 20 and are operatively associated with SCR's 56, 58 (FIG. 3). The SCR's 56 are individually identified as 56A, 56B, and are operatively associated with secondaries 50S respectively, and similarly the SCR's 58 are individually identified 58A, 58B, and are operatively associated with secondaries 52S respectively.

Upon energization of the secondaries 50S, 52S, as explained hereinbelow, they turn on the SCR's 56, 58, and control the current from the poower transformer 32 to the chuck 20, and specifically, the transformer 50, or CHARGE set, is utilized for holding the workpiece on the chuck in grinding operation, and both sets are utilized for performing the DEMAGGING operation.

The Control Circuit - FIGS. 4–7

The control circuit of FIGS. 4–7, includes a pulse trigger circuit 28A (FIG. 4)(1, 4, 10, 16). This pulse trigger circuit 28A enters into the operation of the remote control station 28D (FIGS. 6 and 7) in manually setting up and establishing the various modes, in various ways as described hereinbelow. Referring specifically to this pulse trigger circuit, the control secondary 32S3 (1) functions to control the entire control circuit 28. This secondary provides 15 VAC which is rectified by full wave rectifiers 60, 62 (4). The rectified output of the rectifier 60 is unfiltered and is used in the zero-crossing detector circuit (see below) which generates the trigger pulses necessary to control the DC voltage applied to the chuck. The rectified output of the rectifier 62 is filtered through capacitors 64, 66 (3), which is then applied to the input of a voltage regulator 68 (4). The rectifier 62 and voltage regulator 68 are incorporated in the circuit component 28B (3) identified as 12 VDC regulated supply. This supply circuit supplies voltage to the CMOS oscillator circuit 28C (20), the pulse trigger circuit 28A (1, 4, 10, 16) and the remainder of the control circuit 28 (FIGS. 4–7).

The output of the rectifier 60 (4) is pulsating DC, and is used in the zero crossing detector 69 which includes the transistors 70 (5), 72 (6). Each time this pulsating DC reaches the zero level, the transistor 70 turns off, allowing the transistor 72 to conduct, thereby applying forward bias to a transistor 74 (7) and turns it ON. This causes the capacitor 76 (6) to discharge, and this initiates the phase timing sequence, which is arrived at when the capacitor 76 is charged by the RC time constant, that is determined by the value of that capacitor, and resistors 78 (2), individually identified R1 to R9. These resistors are adjustable, as indicated, and they are set so that the resistor R1 will have the least resistance, and in progressing to the right (as in FIG. 4) they individually increase in resistance and the last resistor R9 has the greatest resistance. The lower the resistance, the faster it will charge the capacitor 76 (6), and this results in a higher DC output voltage to be applied to the chuck. The voltage across the capacitor 76 (6) is monitored by a transistor 80 (9). A transistor 82 (10) is used as a voltage reference for the transistor 80. When the voltage of the capacitor 76 (6) rises above the reference voltage set by the transistor 82 (10), the transistor 80 (9) will turn ON. The base-emitter voltage variations of the transistor 80 (9) caused by temperature changes will be compensated for by base-emitter voltage variations of the transistor 82 (10). A transistor 84 (11) buffers the output of the transistor 80 (9), and the output of the transistor 84 is then differentiated by a capacitor 86 (11) to obtain a trigger pulse.

Attention is directed to a series of terminals numbered 1–10 respectively, which appear in a group, (at each of lines 28, 31) and certain ones of those same terminals appear again at other locations in the general circuitry. One of those terminals, No. 7, appears also in FIG. 4 (12), and terminal No. 9 appears in a second location again in line 28.

If a high (HI) signal is applied at terminal No. 7 (12, 33), a trigger pulse appears at pin 3 of gate 88 (12), and then, depending on the state of the CMOS oscillator 28C (20), or mode of operation, either of the gates 90 (12) or 92 (13) is enabled, these latter gates 90, 92, being operably associated with the transformers 50 (9), 52 (15), respectively. The secondaries of these transformers thereupon energize the corresponding SCR's 56, 58, (FIG. 3) for correspondingly energizing the secondaries 50S, respectively. These transformers are thereby utilized in the overall demagging operation, including the specific steps of MAGGING and DEMAGGING, as will be referred to again hereinbelow.

FIGS. 4 and 5 together include conductors extending into both figures, and they are marked with letters a–h inclusive, at the bottom of FIG. 4 and the top of FIG. 5, for identification of the respective continuous conductors.

Reference is now made to other portions of the control circuit 28 (FIG. 5).

The CMOS oscillator circuit 28C (20) incluees an oscillator chip 94 (22) used with an RC network which includes resistors 98, 100, 102 (21), 105(25), 107(27) and capacitor 104 (22). The resistors 105, 107, are selectively switched into the circuit by means of digital switches 108 (25), 109 (27), providing HARD (slow), MEDIUM, and SOFT (fast) in overall cycle time at pin 6 (clock) of the oscillator chip 94, as will be referred to again hereinbelow. The clock signal thus produced is applied to the inputs of gates 110, 112, (18) and pin 3 of a flip-flop 114 (21). The complementary outputs 1 and 2 of the flip-flop 114 enable or disable the gates 110, 112, thus turning ON or OFF either transistor 116 or 118 (14) depending on the cycle. The oscillator is continuously operating.

Remote Control Station - FIGS. 6–7 - Operating Modes

FULL Mode

In the FULL mode the chuck 20 is charged to its ultimate level according to the design and setting of the apparatus as a whole. The apparatus is designed to provide a maximum charge on the magnet, which is the FULL mode, and it cannot be changed by the operator, but a lesser charge is utilized as a maximum in VARIABLE mode as will be referred to again hereinbelow. In keeping with the design and purpose of the apparatus, the charge in the FULL mode is that charge desired for the largest workpieces.

Figure 8:
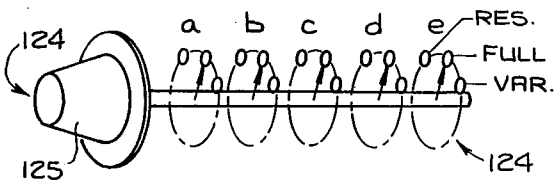
FIG. 8 is a simplified diagrammatic view of a certain switch utilized in the circuit (in FIG. 6).

To establish the FULL mode, the operator sets the switch 124 (31) in FULL position (see also FIG. 8). The switch 124 is 5 pole, triple throw ganged rotary switch, having a manipulating knob 125.

Figure 9:
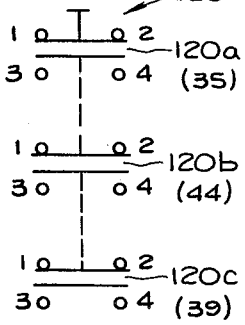
FIG. 9 is a simplified diagrammatic view of another switch incorporated in the circuit (in FIGS. 6 and 7).

The operator then moves the switch 122 (44) to POWER position. This switch is a bistable switch, remaining in the position to which it is moved, until the next actuation thereof. A green POWER light 123 (48) is turned ON in this step. The circuit remains inactive until the next step, namely the operator then actuates the CHARGE switch 120 (34, 44, 38), this switch also being shown in its entirety in FIG. 9. Actuation of this switch 120 starts the timer 148 (34) which has an internal law of operation so as to run through a predetermined period of time. Such period of time is as desired, but as used herein, and constituting an example, has a maximum running period of seven seconds. The operation of the timer through that period sets up the mxximum charge on the chuck for the FULL mode, but the timer in other steps in the operation is actuated through a shorter period of time, such as five seconds, three seconds, etc. Although the timer 148 has an internal law of operation, the apparatus includes external components for setting the time period of operation of the timer. These include adjustable resistors or rheostats 126 (31), 128 (34) and a capacitor 131 (35). However, these adjustments are not brought into actuation in the FULL mode, but in the VARIABLE and RESIDUAL modes. In FULL mode, the switch pole 124*a* is connected with a fixed resistor 127 (32).

Closure of the CHARGE switch 120 (44) enables the gate 88 (12) and allows the trigger pulses from the zero crossing detector 69 (5) to pass therethrough. As stated above, these pulses passing through the gate 88 (12) again pass through either of the 90 (12) or gate 92 (13) according to the state of the CMOS oscillator 28C (24), and in this FULL mode, the gate 90 is enabled, energizing the transformer 50 (15) and as stated above and as shown additionally in FIG. 3, this transformer, acting through its two secondaries 50S1, 50S2 (FIG. 3) provides full rectified current of a first polarity to the chuck.

Thus in this FULL mode setting, the charge is applied to the chuck throughout the time period of operation of the timer 148 (34) which in this specific case, is seven seconds. That time period is predetermined, and the various components are pre-selected according to operating characteristics, that the chuck is fully charged at the end of that time period, and at that time, the output pin 3 of the timer goes LO and disables the gate 88 (12) and turns it OFF. It will be noted that the pulse from pin 3 passes through terminal 7 (43 and 12). Because of this, the control circuit of FIGS. 4–7 is made inactive, and also the power circuit of FIG. 3 is made inactive through the de-energization of the transformer 50.

The condition of the charge on the chuck is described hereinbelow under Current Sensing.

As referred to above, the magnet in the chuck 20 is an electric permanent magnet, and upon its being charged, it is disconnected from the circuit, and it retains a FULL charge as in a natural magnet, indefinitely. This provides a great safety factor as contrasted with an electromagnet. In the case of the latter, the charging circuit must remain connected, but in the present case, in the event of a power failure, the magnet would retain its full magnetism, and there would be no danger of the grinder throwing a workpiece off.

VARIABLE Mode

The apparatus in the VARIABLE mode functions the same as in the FULL mode, but charges the chuck to a level less than that in FULL mode. The level of the charge is determined by a time period, that is, the charge applied to the chuck is so applied throughout a predetermined time period and the level is so determined by the length of that period. Thus, a FULL mode charge is effected, in the present case, in the time period of seven seconds, and a lesser charge, in the VARIABLE mode, is applied in a shorter time period, being so applied through the duration of that shorter period. The level of the charge to be accomplished in the VARIABLE mode is as determined for the characteristics of the workpiece to be held in place. Given a maximum time period (seven seconds) for FULL mode, and it is desired to establish a 60% charge for a VARIABLE mode, the timer 148 is set to run a corresponding period which in that case would be slightly over four seconds. As noted above, that time period for the timer is manually set, by setting the adJustable resistor or rheostat 128 (34) to a corresponding position. The capacitor 131 (35) is of fixed characteristics, and therefore the timer is adjusted by the rheostat alone.

To set the apparatus into operation for the VARIABLE mode, the rheostat 128 (34) is set, as stated, and the switch 124 (32) is set to VARIABLE, and the switch 122 (44) set to POWER position. The apparatus thereupon proceeds to charge the chuck as described above in connection with the FULL mode, and it terminates operation, and goes into an inactive condition, at the end of the new time period of the timer 148(34).

RESIDUAL Mode

As noted above, it is desired at times to reduce the holding power of the magnetic chuck to a lower level, to enable removal of a workpiece for performing a testing operation thereon, and to return it to the chuck after the testing. For this purpose, the holding power is reduced, not to zero, but to a level significantly above zero, so as to hold the remaining workpieces in place. The piece that was removed is cleaned, and its place on the chuck is cleaned, and after the piece is returned to its position, all the pieces are then held in proper position. The RESIDUAL mode is utilized only while the grinding operation is not being performed, as will be understood.

To reduce the holding power, or the level of magnetism, of the chuck, a charge is imposed thereon of a polarity opposite that originally applied. In such a step, assuming an original holding power of 100%, and it is desired to reduce that holding power, in the RESIDUAL mode, to for example 10%, then a charge of the opposite polarity is imposed on the chuck, this charge being of a magnitude representing the 90% difference between the 100% and the 10%. This charge, representing 90%, is produced again in a timing operation, or a reduced time period of the timer 148 (34), and in the example given, this time period would be 90% of the maximum, or 90% of seven seconds, or approximately 6.3 seconds.

In setting up or establishing the RESIDUAL mode, the operator sets the adjustable resistor 126 (31) and places the switch 124 (31) in FIG. 8 in the RESIDUAL position. This enables the CMOS 28C, which begins its cycle, and turns on the RESIDUAL light 167 (44).

This enables the gate 110 (19), which turns on the transistor 118 (14). As in the previous modes, upon initiation of the RESIDUAL mode as just described, the timer 148 (34) begins operation, and the output is placed on terminal 7 (12) and enables the gate 88 (12).

As the result of these steps, the gate 92 (13) is turned ON and the trigger pulses pass through that gate. Consequently the transformer 52 (15) is energized, and referring to FIG. 3 it is pointed out that the transformer 52 produces full wave rectified DC on the chuck 20, and this DC is of polarity opposite that produced earlier through the transformer 50 in the FULL mode, in which the holding charge is imposed on the chuck. At the end of the time cycle of the timer 148 (34), which in this mode is 6.3 seconds, it shuts off, and the apparatus comes to a standstill, and particularly the imposition of the charge on the chuck terminates, and because of the reduced charge on the chuck, the workpiece can be lifted from the chuck.

In this case, that is, in the RESIDUAL mode, the operation of the apparatus is essentially the same as that in the FULL mode and VARIABLE mode, but producing a charge of opposite polarity.

After the completion of the desired steps, in the RESIDUAL mode, the apparatus is again then put into operation to bring it to the FULL mode, or the VARIABLE mode, in the manner referred to above, and the grinding operation is continued, after which the workpieces are released from the chuck as referred to below in the description of the RELEASE mode.

RELEASE Mode

The RELEASE mode represents the DEMAGGING phase, that is, the magnetism is reduced to zero so that the workpiece is released.

In the RELEASE mode there is provision for accommodating workpieces of different natures, such as hard steel, medium steel and soft iron, in which the steps are of different timing in the RELEASE operation. For example in the case of hard steel, a longer time is provided for initially saturating the chuck and workpieces to the desired extent, and a medium time period is required for medium steel, and a faster time may be used for soft iron. These steps are effected by the following three switches, a HARD switch 136 (39), a MEDIUM switch 132 (33), and a SOFT switch 129 (32). Preferably these switches are of momentary character.

At this point in the operation, selection is made as to slow, medium, or fast period to be used in the DEMAGGING phase. The timing of the DEMAGGING phase is determined by the oscillator chip 94 (22) according to which of the resistors 102, 105, and 107 are in circuit therewith, the chip 94 producing the corresponding time intervals according to its internal characteristics. When the HARD switch 136 (40) is actuated, the resistor 102, which is fixed, is put in circuit, and when the MEDIUM switch 132 (33) is actuated, the digital switch 108 is closed and the resistor 105 is put in circuit, and when the SOFT switch 129 (31) is actuated, the digital switch 109 is closed and the resistor 107 is put in circuit. The latter two resistors 105, 107, are put in circuit individually, but each in parallel with the fixed resistor 102.

After actuating the desired switch, e.g. 136 (39) the operator actuates the POWER/RELEASE switch 122 (44) and moves it to RELEASE position. This switch is a three pole, double throw switch, and is moved to its alternate opposite positions successively.

After the foregoing steps, the selected switch, the HARD switch 136 (39) is connected in circuit with the RELEASE switch **122*a* (44), and thereupon the CMOS oscillator 28C starts. In this step, the LO signal goes through terminal 10 (29) and transistor 146 (26) is turned OFF. Thereby the oscillator unit 94 (22) is enabled, and the output thereof at pin 6 controls gates 110 (19) and 112 (20**) and turns them ON and OFF alternately.

The clock output of unit 94 (22) at pin 6 then goes HI and LO alternately at a predetermined rate, according to the HARD setting and the characteristics of the unit. The HI and LO signals from the pin 6 progress through the circuit and are applied to a reset chip 166 (7) associated with chips 168, 170, and transistor 171 (4), and together with the latter associated with the resistors 78 (2) referred to above. These chips operate according to certain internal characteristics according to their nature and their functioning need not be described in detail. The reset chip 166 (7) may be of any known and desired kind, such as Motorola Decade Counter-Divider MC14017B. Each time the oscillator chip 94 (22) ouput goes HI, the HI signal is applied to the chip 166 (7) and that chip steps into its next position, i.e. to pin 2 of that chip, and this represents the firt DEMAG or RELEASE pulse, Each of the chips 168, 170, has 4 NPN transistors built into it, and those transistor and the transistor 171 therewith are connected respectively with the nine resistors 78. As the chip 166 (7) progresses each step into its next position, the resistors 78, namely R1–R9, are individually put into circuit, beginning from the left to the right (FIG. 4) and as noted above, each resistor is of higher resistance than the previous one. This results in the capacitor 76 (6) being charged at a slower rate in each step and this in turn results in a trigger pulse that allows the power SCR's 56, 58 (FIG. 3) to conduct less in each successive step, and since the voltage is thereby reduced in successive alternate steps, the magnetism of the magnet is reduced to zero, or substantially so. The chip 166 (7) according to its internal characteristics shuts off at the end of nine steps, i.e. coinciding with the number of resistors 78 (2) and thus shuts off the apparatus when the magnetism reaches zero.

Current Sensing

An adjustable resistor 174 (FIG. 3, bottom) is put in series with the chuck 20 through which is developed a voltage drop of e.g. 2 V, which is sensed by a comparator 175 (21). Through gates 177 and 155, terminal 9 goes LO (28 left, 42). This enables gate 178 (48) through gates 180, 182 (50), and turns on the CHARGED light 184 (45), thus indicating a proper charge on the chuck.

We claim:

1. Chuck control apparatus for controlling a chuck having an electric permanent magnet therein comprising, circuitry including a power circuit with a source of power therein, and a control circuit, the power circuit including an electric permanent chuck, a power transformer including power secondaries in the power circuit and control secondary in the control circuit, and operable for charging the chuck, magnetizing control transformers having primaries in the control circuit and secondaries in the power circuit and operable for controlling the charging of the chuck, means acting through the control secondary in the control circuit for energizing the magnetizing control transformers and the magnetizing control transformers thereby being operable for completing circuit between the power secondaries and the chuck and consequently charging the chuck, and a selectively manually pre-settable charging timer operable, at the expiration of a predetermined set time interval, for disabling the magnetizing control transformers, and thereby terminating the charging of the chuck.

2. Apparatus according to claim 1 and including, means operable for effecting application of unidirectional DC on the chuck throughout said time interval, for so charging the chuck.

3. Apparatus according to claim 1 and including, means operable for reflecting application of DC to the chuck, in successively opposite polarities, throughout a predetermined number of time intervals, means for reducing the voltage in successive time intervals and selectively manually pre-settable means for predetermining the maximum voltage applied to the chuck.

4. Apparatus according to claim 1 and including, means for manually setting the timer selectively at different time intervals, whereby to produce a FULL charge of relatively greater value, and a VARIABLE charge of relatively lesser value, selectively on the chuck.

5. Apparatus according to claim 1 and including, means operable for effecting application of DC to the chuck of a first polarity, the timer being settable for operation throughout a relatively greater time interval, whereby to produce FULL charge of a relatively higher level on the chuck, of a corresponding first polarity, means operable for effecting application of DC to the chuck of opposite polarity, and the timer being settable for operation throughout a relatively lesser time interval, and thereby operable for effecting application of DC of said opposite polarity on the chuck for a corresponding lesser time interval and thereby producing a RESIDUAL charge of relatively lower level on the chuck.

6. Apparatus according to claim 1 and including, current sensing means, the current sensing means including a resistor in series with the chuck and establishing a voltage thereacross in response to current being applied to the chuck, and a signal light connected in circuit and arranged to sense the voltage drop across the resistor and being lighted in response to current being applied to the chuck.

7. A method of controlling the magnetism of an electric permanent magnet comprising, applying DC to the magnet throughout a first manually pre-set, predetermined time interval, and thereby charging the magnet to a charge level according to the time interval, and applying DC of polarity opposite that of the first time interval through a second manually pre-set, predetermined time interval and thereby reducing the charge of the magnet to a level greater than zero.

8. Apparatus according to claim 1 and including, means for demagnetizing the chuck, and selectively manually pre-settable discharging timer means, operable independently of the charging timer, for predetermining the termination of the operation of the demagnetizing means.

9. Apparatus according to claim 3 and including, capacitor means, a plurality of resistors of different values, means for charging the capacitor, means for connecting the resistors individually and in succession in series with the capacitor means and thereby controlling the decrease in charge on the capacitor to levels corresponding with the values of the resistors respectively, and means including the capacitor means for charging the chuck at each time interval an extent corresponding to the level of charge on the capacitor means.

* * * * *